US010173245B1

(12) United States Patent
Greene

(10) Patent No.: US 10,173,245 B1
(45) Date of Patent: Jan. 8, 2019

(54) TWO-STAGE SOIL SIFTING DEVICE

(71) Applicant: Michael Greene, Sloatsburg, NY (US)

(72) Inventor: Michael Greene, Sloatsburg, NY (US)

( * ) Notice: Subject to any disclaimer, the term of this patent is extended or adjusted under 35 U.S.C. 154(b) by 0 days.

(21) Appl. No.: 15/900,476

(22) Filed: Feb. 20, 2018

(51) Int. Cl.
*B07B 1/04* (2006.01)
*B07B 1/00* (2006.01)

(52) U.S. Cl.
CPC ..... *B07B 1/04* (2013.01); *B07B 1/005* (2013.01); *B07B 2201/04* (2013.01)

(58) Field of Classification Search
CPC .. B07B 1/005; B07B 1/04; B07B 1/46; B07B 2201/04
USPC ..... 209/315–319
See application file for complete search history.

(56) References Cited

U.S. PATENT DOCUMENTS 79,497 A * 6/1868 Patterson ..... B07B 1/00 209/331
494,952 A * 4/1893 Hardy ..... B07B 1/42 209/329
563,046 A * 6/1896 Mait ..... B03B 5/08 209/440
588,252 A * 8/1897 Waer ..... B03C 1/06 209/40
679,648 A * 7/1901 Thornton ..... B07B 1/286 209/316
825,390 A * 7/1906 Hill ..... B07B 1/46 209/315
1,087,765 A * 2/1914 Hatfield ..... B07B 1/005 209/319
1,510,742 A 10/1924 Gutleben
1,774,893 A 9/1930 Krider
1,820,944 A 9/1931 Marx
1,915,602 A * 6/1933 Goody ..... B03B 5/08 209/273
4,371,435 A * 2/1983 Eckersley ..... B03B 5/26 209/257
4,642,180 A * 2/1987 Kaufman ..... B07B 9/00 209/414
4,699,713 A * 10/1987 Tieben ..... B07B 1/42 209/315
D350,675 S 9/1994 Salisbury
6,712,218 B2 3/2004 Nierop
6,799,681 B1 * 10/2004 Warren ..... B03B 5/26 209/268

(Continued)

FOREIGN PATENT DOCUMENTS

WO 2004072399 A 12/2006

*Primary Examiner* — Joseph C Rodriguez
(74) *Attorney, Agent, or Firm* — Kyle A. Fletcher, Esq.

(57) ABSTRACT

The two-stage soil sifting device comprises a support frame, an upper sifter, and a lower sifter. The support frame comprises a rectangular base with cross braces and four vertical uprights that support the upper sifter and the lower sifter at elevated positions. The upper sifter comprises an upper sifter frame and a first mesh having a first mesh spacing. The upper sifter is located above the lower sifter and may be pivotally inclined with respect to horizontal. The lower sifter comprises a lower sifter frame and a second mesh having a second mesh spacing. As unsifted soil placed upon the upper sifter is moved over the surface of the upper sifter some of it passed through the first mesh onto the lower sifter and then through the second mesh onto the ground, leaving debris on the first mesh and on the second mesh.

15 Claims, 4 Drawing Sheets

(56) References Cited

U.S. PATENT DOCUMENTS

| | | | | |
|---|---|---|---|---|
| 7,438,188 | B2 * | 10/2008 | Stolworthy | B03B 5/04 209/13 |
| 8,317,031 | B2 | 11/2012 | Zeller | |
| 8,678,192 | B1 * | 3/2014 | Pung | B03B 5/26 209/18 |
| 8,813,968 | B1 | 8/2014 | Mandeville | |

* cited by examiner

TWO-STAGE SOIL SIFTING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of gardening equipment, more specifically, a two-stage soil sifting device.

SUMMARY OF INVENTION

The two-stage soil sifting device comprises a support frame, an upper sifter, and a lower sifter. The support frame comprises a rectangular base with cross braces and four vertical uprights that support the upper sifter and the lower sifter at elevated positions. The upper sifter comprises an upper sifter frame and a first mesh having a first mesh spacing. The upper sifter is located above the lower sifter and may be pivotally inclined with respect to horizontal. The lower sifter comprises a lower sifter frame and a second mesh having a second mesh spacing. As unsifted soil placed upon the upper sifter is moved over the surface of the upper sifter some of it passed through the first mesh onto the lower sifter and then through the second mesh onto the ground, leaving debris on the first mesh and on the second mesh.

An object of the invention is to provide a device that sifts soil.

Another object of the invention is to provide a device that sifts using two meshes of different mesh spacings.

A further object of the invention is to allow the inclination angle of the upper sifter to be changed.

Yet another object of the invention is to provide two front wheels and two rear handles to facilitate moving the device.

These together with additional objects, features and advantages of the two-stage soil sifting device will be readily apparent to those of ordinary skill in the art upon reading the following detailed description of the presently preferred, but nonetheless illustrative, embodiments when taken in conjunction with the accompanying drawings.

In this respect, before explaining the current embodiments of the two-stage soil sifting device in detail, it is to be understood that the two-stage soil sifting device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the two-stage soil sifting device.

It is therefore important that the claims be regarded as including such equivalent construction insofar as they do not depart from the spirit and scope of the two-stage soil sifting device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
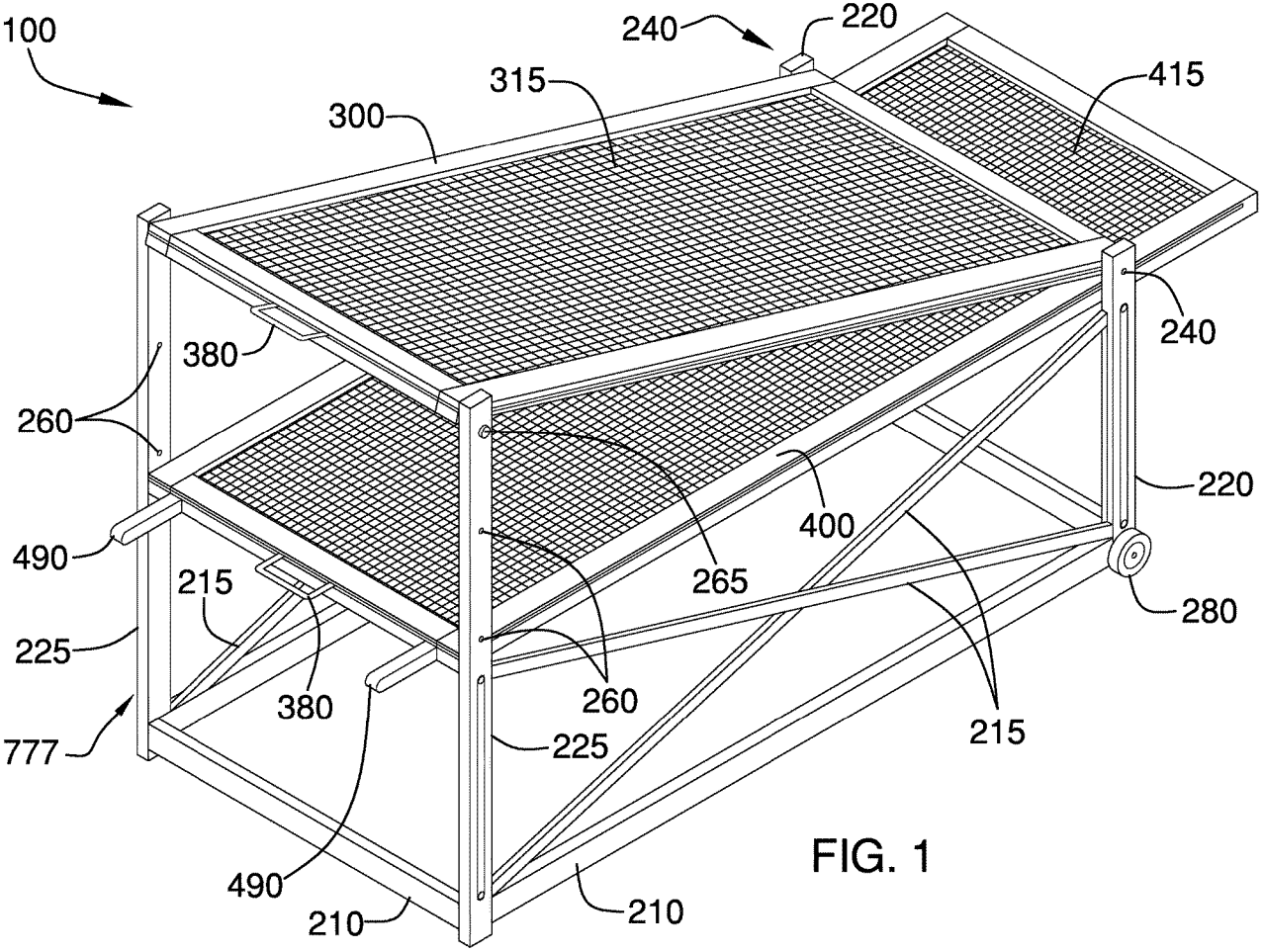
FIG. 1 is a perspective view of an embodiment of the disclosure.
Figure 2:
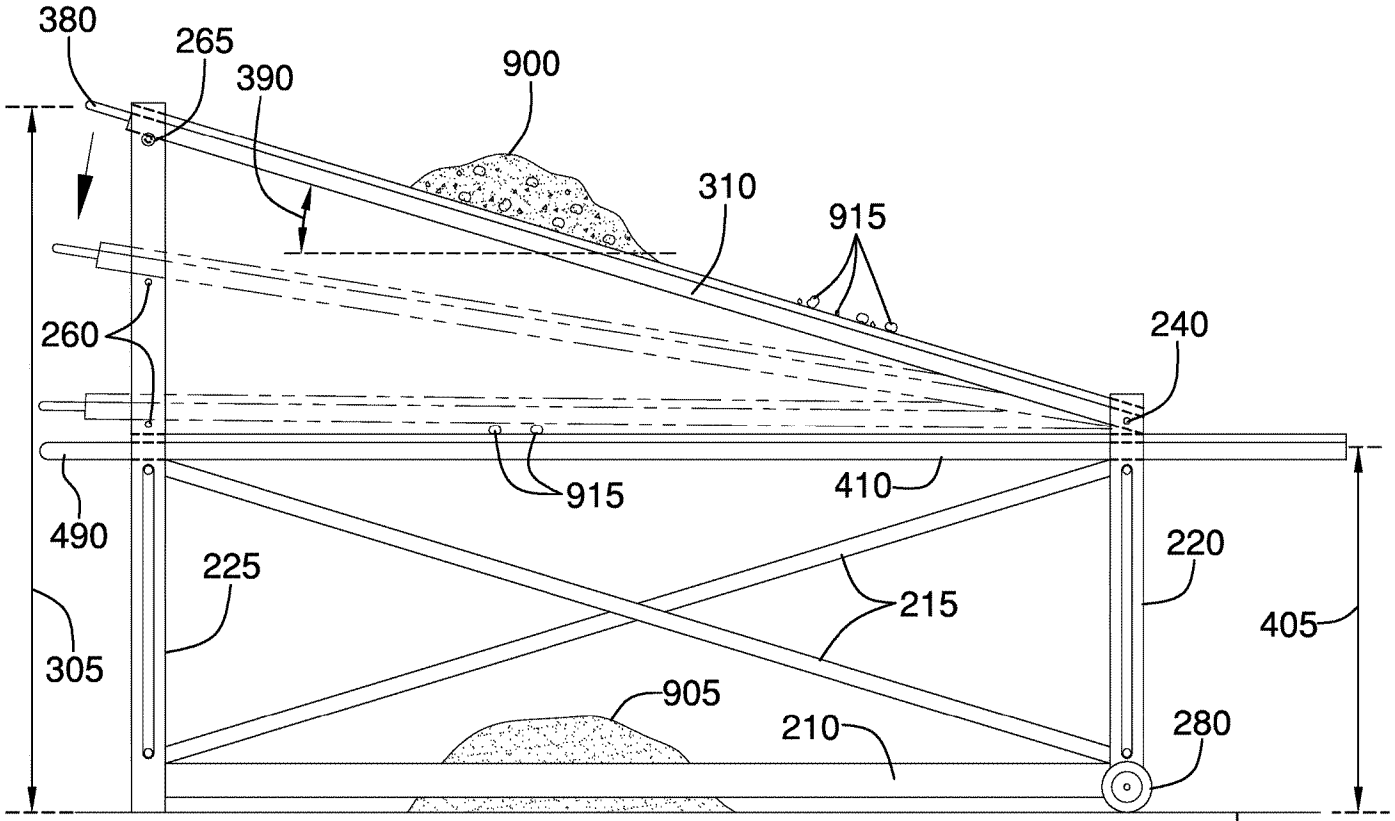
FIG. 2 is a side view of an embodiment of the disclosure.
Figure 3:
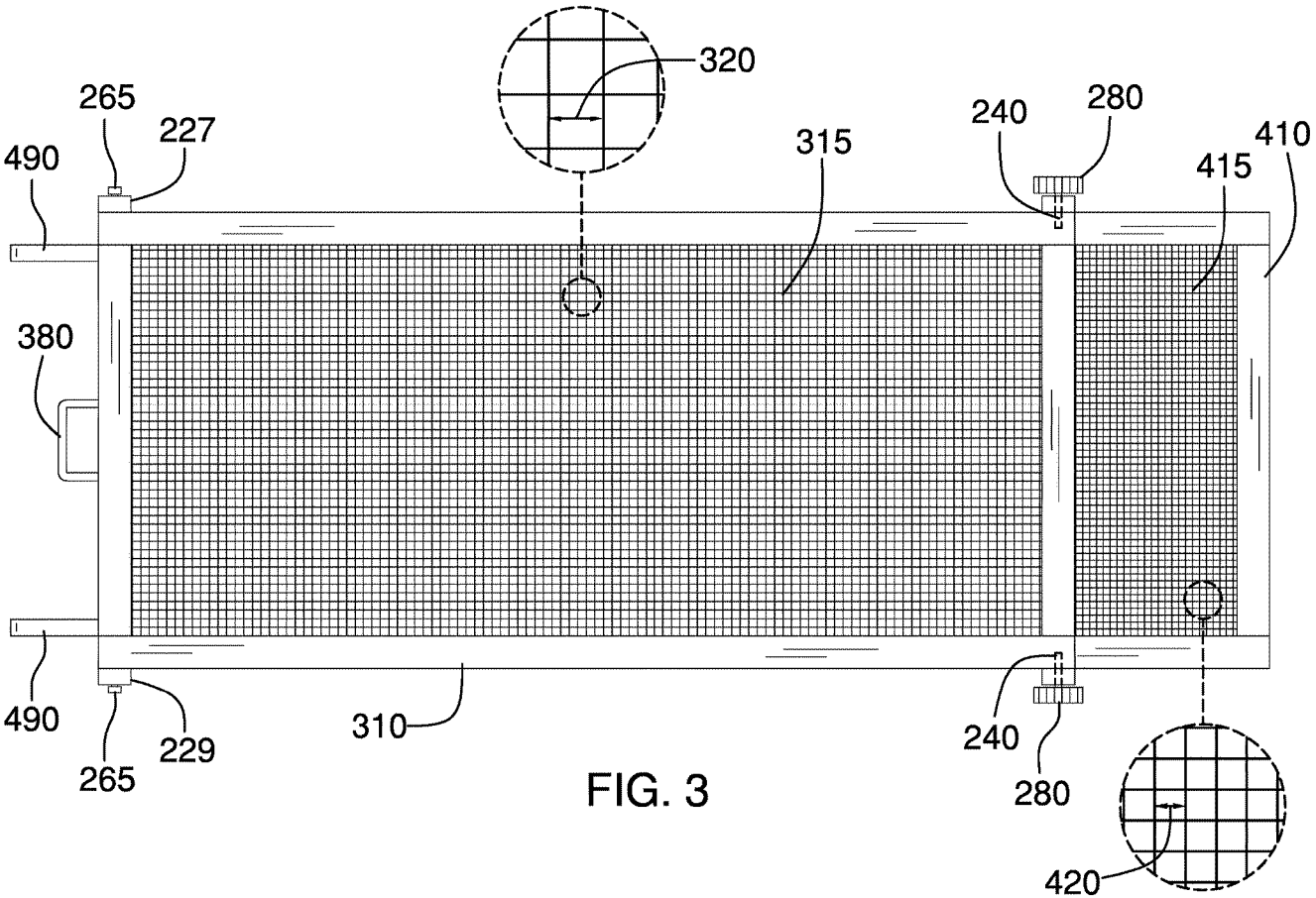
FIG. 3 is a top view of an embodiment of the disclosure.
Figure 4:
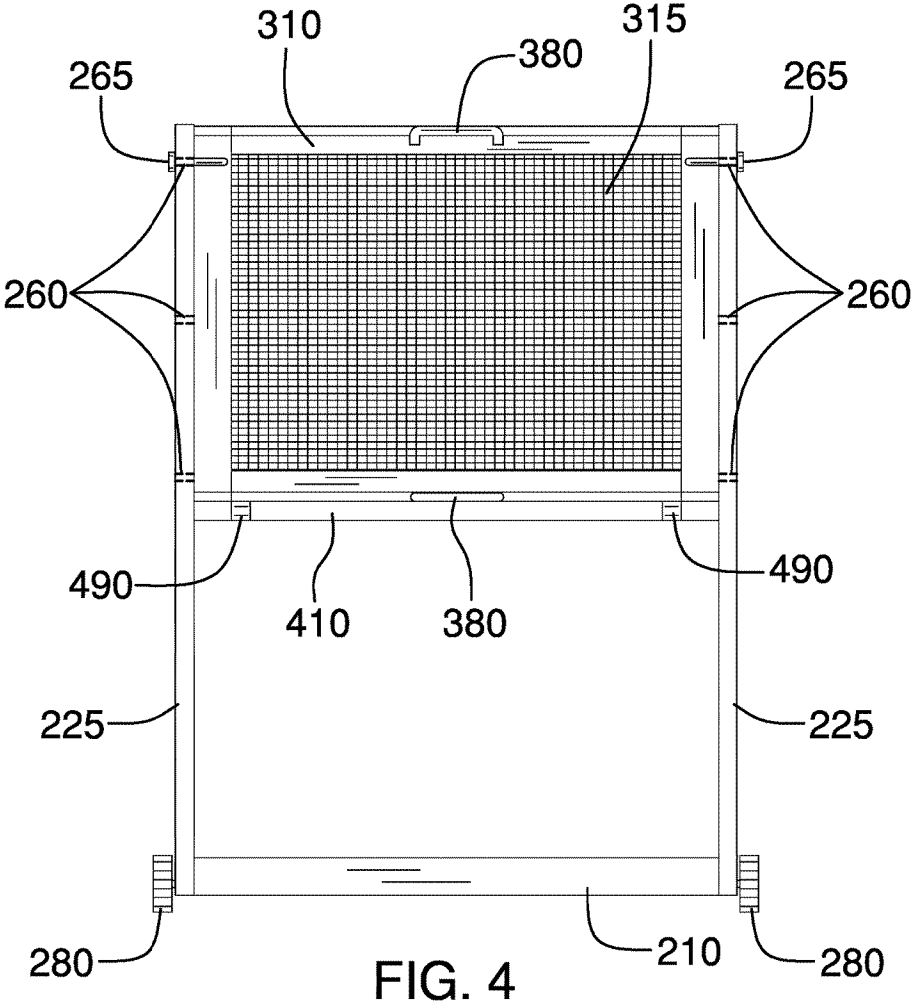
FIG. 4 is a cross-rear sectional view of an embodiment of the disclosure.

Detailed reference will now be made to a first potential embodiment of the disclosure, which is illustrated in FIGS. 1 through 4.

The two-stage soil sifting device 100 (hereinafter invention) comprises a support frame 777, an upper sifter 300, and a lower sifter 400. The invention 100 may separate debris 915 out of unsifted soil 900. The upper sifter 300 may prevent rocks, wood chips, and items larger than a first diameter from falling to the lower sifter 400 but may allow sifted soil 905 and items smaller than the first diameter to fall to the lower sifter 400. The lower sifter 400 may prevent pebbles and items larger than a second diameter from falling through the lower sifter 400 but may allow the sifted soil 905 and items smaller than the second diameter to fall through the lower sifter 400. The sifted soil 905 may collect under the lower sifter 400. Specifically, the sifted soil 905 may collect on the ground 910 or may collect in a basin (not illustrated in the figures) placed under the lower sifter 400.

Throughout this disclosure, the front of the invention 100 is defined to be the side of the invention 100 where a pair of wheels 280 are located. The rear of the invention is the side opposite the front, which coincides with the side where a pair of handles 490 are located.

The support frame comprises a plurality of horizontal frame elements 210, a plurality of cross braces 215, a pair of front vertical supports 220, and a pair of rear vertical supports 225. The support frame may be a support structure, which elevates the upper sifter 300 and the lower sifter 400. The plurality of horizontal frame elements 210 may form a rectangular base at the lowest level of the invention 100. The rectangular base may be oriented parallel to the ground 910.

The pair of front vertical supports 220 may be coupled to the front corners of the rectangular base and may rise vertically from the front corners of the rectangular base. The pair of front vertical supports 220 may rise to a height of the lower sifter 405.

The pair of rear vertical supports 225 may be coupled to the rear corners of the rectangular base and may rise vertically from the rear corners of the rectangular base. The pair of rear vertical supports 225 may rise to a maximum height of the upper sifter 305.

The lower sifter 400 may be coupled to the support frame at the height of the lower sifter 405. Specifically, the rear corners of the lower sifter 400 may couple to the pair of rear vertical supports 225 at the height of the lower sifter 405 and the lower sifter 400 may be coupled to the top of the pair of front vertical supports 220 at the height of the lower sifter 405. The lower sifter 400 may extend forward from the pair of front vertical supports 220.

The plurality of cross braces 215 may be X-shaped support elements oriented diagonally at the front and the rear of the support frame. The plurality of cross braces 215 may provide stability in a lateral direction. Specifically, the plurality of cross braces 215 may run from one of the pair of rear vertical supports 225 on left side to one of the pair of rear vertical supports 225 on right side and from one of the pair of front vertical supports 220 on the left side to one of the pair of front vertical supports 220 on the right side. Height-wise, the plurality of cross braces 215 may run from the rectangular base to the lower sifter 400.

The support frame may retain the upper sifter 300 at an inclination angle 390. The inclination angle 390 may be adjustable. Specifically, the front of the upper sifter 300 may be pivotally coupled to the top of the pair of front vertical supports 220 and the rear of the upper sifter 300 may be adjustable in height up to the maximum height of the upper sifter 305. The front of the upper sifter 300 may pivot at a pair of pivot pins 240. The inclination angle 390 may be determined by a height adjuster located on the pair of rear vertical supports 225. In some embodiments, the height adjuster may comprise a plurality of height adjustment holes 260 on both a left rear vertical support 227 and on a right rear vertical support 229 and a pair of height adjustment pins 265. The pair of height adjustment pins 265 may be inserted into the plurality of height adjustment holes 260 at the same height on both sides and the rear of the upper sifter 300 may rest upon the pair of height adjustment pins 265 to retain the upper sifter 300 at a specific angle.

The support frame may comprise the pair of wheels 280 for moving the invention 100. The pair of wheels 280 may be located on the bottom of the pair of front vertical supports 220. The pair of wheels 280 may contact the ground 910 while holding the pair of front vertical supports 220 above the ground 910. In some embodiments, the pair of rear vertical supports 225 may extend downward below the rectangular base by ½ of the diameter of the pair of wheels 280 in order to compensate for the elevation of the front of the rectangular base by the pair of wheels 280 and thereby keep the invention 100 level.

The upper sifter 300 may comprise an upper sifter frame 310 and a first mesh 315. The upper sifter frame 310 may be a rectangular framework for supporting the first mesh 315. The upper sifter frame 310 may be the width of the rectangular base. The length of the upper sifter frame 310 may be at least the distance from the top of the pair of front vertical supports 220 to the top of the pair of rear vertical supports 225 as measured on the same side.

The first mesh 315 may comprise a barrier made of connected strands separated at a regular spacing in both lateral and longitudinal directions. The connected strands may be spaced at a first mesh spacing 320. The first mesh 315 may allow objects smaller than the first mesh spacing 320 to fall through the first mesh 315 and may prevent objects larger than the first mesh spacing 320 from falling through the first mesh 315.

The upper sifter 300 and the lower sifter 400 may each include an adjusting handle 380. The adjusting handle 380 may be located on the rear of the upper sifter frame 310, and on the rear of the lower sifter frame 410. The adjusting handle 380 may be used to raise and lower the rear of the upper sifter 300 so that the inclination angle 390 may be changed. The adjusting handle 380 is not to be confused with the pair of handles 490. The pair of handles 490 aid in moving the invention 100; whereas the adjusting handle 380 is used to manipulate the upper sifter or the lower sifter 400 with respect to the support frame 777.

The lower sifter 400 may comprise a lower sifter frame 410 and a second mesh 415. The lower sifter frame 410 may be a rectangular framework for supporting the second mesh 415. The lower sifter frame 410 may be the width of the rectangular base. The length of the lower sifter frame 410 may be at least the distance from the top of the pair of front vertical supports 220 to the top of the pair of rear vertical supports 225 as measured on the same side.

The second mesh 415 may comprise a barrier made of connected strands separated at a regular spacing in both lateral and longitudinal directions. The connected strands may be spaced at a second mesh spacing 420. The second mesh 415 may allow objects smaller than the second mesh spacing 420 to fall through the second mesh 415 and may prevent objects larger than the second mesh spacing 420 from falling through the second mesh 415.

In some embodiments, the second mesh spacing 420 may be smaller than the first mesh spacing 320.

In some embodiments, the first mesh 315 and/or the second mesh 415 may be removable from the upper sifter frame 310 and from the lower sifter frame 410, respectively. Once removed, the first mesh 315 and the second mesh 415 may be replaced by either the same mesh or by a different mesh having a different mesh spacing.

It shall be noted that the adjusting handle 380 of the upper sifter 300 enables the first mesh 315 to be removed from the upper sifter frame 310; whereas the adjusting handle 380 of the lower sifter 400 enables the second mesh 415 to be removed from the lower sifter frame 410.

As non-limiting examples, the first mesh 315 may be surrounded by a first mesh border (not illustrated in the figures) and the second mesh 415 may be surrounded by a second mesh border (not illustrated in the figures) where the first mesh border may be separable from the upper sifter frame 310 and the second mesh border may be separable from the lower sifter frame 410 after releasing one or more screen retainers on both the upper sifter frame 310 and the lower sifter frame 410.

The lower sifter 400 may comprise the pair of handles 490. The pair of handles 490 may be rearward projections of the lower sifter frame 410. The pair of handles 490 may be handgrips that allow the rear of the invention 100 to be lifted so that the invention 100 may be rolled and turned using the pair of wheels 280. One of the pair of handles 490 may be located on the left side of the lower sifter frame 410 and one of the pair of handles 490 may be located on the right side of the lower sifter frame 410.

In use, the unsifted soil 900 may be placed onto the upper sifter 300. The unsifted soil 900 may be slid along the surface of the upper sifter 300; the inclination angle 390 of the upper sifter 300 may assist in doing so. If necessary, the unsifted soil 900 may be pushed up and down along the upper sifter 300 repeatedly using a gloved hand or a tool. As the unsifted soil 900 moves along the upper sifter 300, some of it, which is smaller than the first mesh spacing 320 may pass through the first mesh 315 and fall onto the lower sifter 400. The debris 915 may be left behind on the top of the upper sifter 300.

The sifted soil 905 falling from the upper sifter 300 onto the lower sifter 400 may pass through the second mesh 415 if it is smaller than the second mesh spacing 420. More of the debris 915 than is larger than the second mesh spacing 420 may be left on top of the lower sifter 400. The sifted soil 905 may collect on the ground 910 under the lower sifter 400.

The debris 915 may be removed from the upper sifter 300 and from the lower sifter 400.

The inclination angle 390 of the upper sifter 300 may be changed to obtain best results for the type of the unsifted soil 900. The inclination angle 390 may be changed by grasping the adjusting handle 380, removing the pair of height adjustment pins 265, raising or lowering the rear of the upper sifter 300, reinserting the pair of height adjustment pins 265 into the plurality of height adjustment holes 260 at the desired height, and resting the rear of the upper sifter 300 on the pair of height adjustment pins 265.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, the words "couple", "couples", "coupled" or "coupling", refer to connecting, either directly or indirectly, and does not necessarily imply a mechanical connection.

As used in this disclosure, "debris" refers to unwanted material.

As used herein, the word "desired" refers to a specific value within a range of supported values. A "desired" value indicates that a range of values is enabled by the invention and that a user of the invention may select a specific value within the supported range of values based upon their own personal preference. As a non-limiting example, for a fan that supports operational speed settings of low, medium, or high, a user may selected a desired fan speed, meaning that the user may select low, medium, or high speed based upon their needs and preferences at the time of the selection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "handle" is an object by which a tool, object, or door is held or manipulated with the hand.

As used herein, the term "height adjustment" refers to a mechanism that allows the overall height of an armature or stanchion to change by releasing a locking mechanism, adjusting a position, and re-engaging the locking mechanism. As a non-limiting example, the locking mechanism may comprise a plurality of holes in a first armature and a plurality of holes in a second armature with a pin passing through the holes when they are in alignment. As a further non-limiting example, the locating mechanism may comprise a spring loaded button on an inside armature that pops through one of a plurality of holes in an outside armature and which can be pressed into the hole to release the locking mechanism.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" or "laterally" refers to the sides of an object or movement towards a side. Lateral directions are generally perpendicular to longitudinal directions.

As used herein, the word "longitudinal" or "longitudinally" refers to a lengthwise or longest direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A two-stage soil sifting device comprising:

a support frame, an upper sifter, and a lower sifter;

wherein the two-stage soil sifting device separates debris out of unsifted soil;

wherein the upper sifter prevents items larger than a first diameter from falling to the lower sifter but allows items smaller than the first diameter to fall to the lower sifter;

wherein the lower sifter prevents items larger than a second diameter from falling through the lower sifter but allows items smaller than the second diameter to fall through the lower sifter;

wherein sifted soil collects under the lower sifter;

wherein the support frame comprises a plurality of horizontal frame elements, a plurality of cross braces, a pair of front vertical supports, and a pair of rear vertical supports;

wherein the support frame is a support structure which elevates the upper sifter and the lower sifter;

wherein the plurality of horizontal frame elements form a rectangular base at the lowest level of the two-stage soil sifting device;

wherein the rectangular base is oriented parallel to ground;

wherein the pair of front vertical supports are coupled to front corners of the rectangular base;

wherein the pair of front vertical supports rise vertically from the front corners of the rectangular base;

wherein the pair of front vertical supports rise to a height of the lower sifter;

wherein the pair of rear vertical supports are coupled to rear corners of the rectangular base;

wherein the pair of rear vertical supports rise vertically from the rear corners of the rectangular base;

wherein the pair of rear vertical supports rise to a maximum height of the upper sifter;

wherein the plurality of cross braces are X-shaped support elements oriented diagonally along the left side and the right side of the support frame;

wherein the plurality of cross braces provides stability in a lateral direction;

wherein the plurality of cross braces run from one of the pair of rear vertical supports on left side to one of the pair of rear vertical supports on right side and from one of the pair of front vertical supports on the left side to one of the pair of front vertical supports on the right side;

wherein the plurality of cross braces run from the rectangular base to the lower sifter.

2. The two-stage soil sifting device according to claim 1 wherein the lower sifter extends forward from the pair of front vertical supports.

3. The two-stage soil sifting device according to claim 1 wherein the support frame retains the upper sifter at an inclination angle;

wherein the inclination angle is adjustable;

wherein the front of the upper sifter is pivotally coupled to the top of the pair of front vertical supports;

wherein the rear of the upper sifter is adjustable in height up to the maximum height of the upper sifter;

wherein the front of the upper sifter pivots at a pair of pivot pins;

wherein the inclination angle is determined by a height adjuster located on the pair of rear vertical supports.

4. The two-stage soil sifting device according to claim 3 wherein the height adjuster comprises a plurality of height adjustment holes on both a left rear vertical support and on a right rear vertical support and a pair of height adjustment pins;

wherein the pair of height adjustment pins are inserted into the plurality of height adjustment holes at the same height on both sides;

wherein the rear of the upper sifter rests upon the pair of height adjustment pins to retain the upper sifter at a specific angle.

5. The two-stage soil sifting device according to claim 3 wherein the support frame comprises a pair of wheels for moving the two-stage soil sifting device;

wherein the pair of wheels is located on the bottom of the pair of front vertical supports;

wherein the pair of wheels contact the ground while holding the pair of front vertical supports above the ground.

6. The two-stage soil sifting device according to claim 5 wherein the pair of rear vertical supports extend downward below the rectangular base by ½ of the diameter of the pair of wheels in order to compensate for the elevation of the front of the rectangular base by the pair of wheels and thereby keep the two-stage soil sifting device level.

7. The two-stage soil sifting device according to claim 1 wherein the upper sifter comprises an upper sifter frame and a first mesh;

wherein the upper sifter frame is a rectangular framework for supporting the first mesh;

wherein the upper sifter frame is the width of the rectangular base;

wherein the length of the upper sifter frame is at least the distance from the top of the pair of front vertical supports to the top of the pair of rear vertical supports as measured on the same side.

8. The two-stage soil sifting device according to claim 7 wherein the first mesh comprises a barrier made of connected strands separated at a regular spacing in both lateral and longitudinal directions;

wherein the connected strands is spaced at a first mesh spacing;

wherein the first mesh allows objects smaller than the first mesh spacing to fall through the first mesh and prevents objects larger than the first mesh spacing from falling through the first mesh.

9. The two-stage soil sifting device according to claim 8 wherein the upper sifter and the lower sifter each include an adjusting handle;

wherein the adjusting handle is located on the rear of the upper sifter frame;

wherein the adjusting handle is used to raise and lower the rear of the upper sifter so that the inclination angle is changed;

wherein the adjusting handle of the lower sifter is located on the rear of the lower sifter frame.

10. The two-stage soil sifting device according to claim 9 wherein the lower sifter comprises a lower sifter frame and a second mesh;

wherein the lower sifter frame is a rectangular framework for supporting the second mesh;

wherein the lower sifter frame is the width of the rectangular base;

wherein the length of the lower sifter frame is at least the distance from the top of the pair of front vertical supports to the top of the pair of rear vertical supports as measured on the same side.

11. The two-stage soil sifting device according to claim 10 wherein the second mesh comprises a barrier made of connected strands separated at a regular spacing in both lateral and longitudinal directions;

wherein the connected strands are spaced at a second mesh spacing;

wherein the second mesh allows objects smaller than the second mesh spacing to fall through the second mesh and prevents objects larger than the second mesh spacing from falling through the second mesh.

12. The two-stage soil sifting device according to claim 11 wherein the second mesh spacing is smaller than the first mesh spacing.

13. The two-stage soil sifting device according to claim 12 wherein the first mesh and/or the second mesh are removable from the upper sifter frame and from the lower sifter frame, respectively;

wherein once removed, the first mesh and the second mesh are replaced by either the same mesh or by a different mesh having a different mesh spacing.

14. The two-stage soil sifting device according to claim 13 wherein the first mesh is surrounded by a first mesh border;

wherein the second mesh is surrounded by a second mesh border;

wherein the first mesh border is separable from the upper sifter frame after releasing one or more screen retainers on the upper sifter frame;

wherein the second mesh border is separable from the lower sifter frame after releasing one or more screen retainers on the lower sifter frame.

15. The two-stage soil sifting device according to claim 14 wherein the lower sifter comprises a pair of handles;

wherein the pair of handles are rearward projections of the lower sifter frame;

wherein the pair of handles are handgrips that allow the rear of the two-stage soil sifting device to be lifted so that the two-stage soil sifting device is rolled and turned using the pair of wheels;

wherein one of the pair of handles is located on the left side of the lower sifter frame and one of the pair of handles is located on the right side of the lower sifter frame.

* * * * *